US005655626A

United States Patent [19]

Spiess

[11] Patent Number: 5,655,626

[45] Date of Patent: Aug. 12, 1997

[54] ROLLER GUIDE FOR A SLIDING ELEVATOR DOOR

[75] Inventor: Peter Spiess, Meggen, Switzerland

[73] Assignee: Inventio AG, Hergiswil NW, Switzerland

[21] Appl. No.: 435,155

[22] Filed: May 5, 1995

[30] Foreign Application Priority Data

May 13, 1994 [EP] European Pat. Off. ..... 94107450

[51] Int. Cl.[6] ..... B66B 13/08; E05D 15/06

[52] U.S. Cl. ..... 187/324; 187/334; 49/409; 160/196.1

[58] Field of Search ..... 187/315, 324, 187/334; 49/10, 11, 409; 160/196.1, 199, 201, 206; 16/45, 91, 107

[56] References Cited

U.S. PATENT DOCUMENTS

| | | | |
|---|---|---|---|
| 421,547 | 2/1890 | Brown | 49/409 |
| 425,477 | 4/1890 | Weaver | 49/409 X |
| 529,919 | 11/1894 | Kingsley | 16/107 X |
| 1,444,349 | 2/1923 | Leeds | 160/196.1 X |
| 1,739,557 | 12/1929 | McTigue | 16/107 |
| 2,611,920 | 9/1952 | Borden | 16/96 |
| 3,426,480 | 2/1969 | Dzamba | 187/334 X |
| 3,460,189 | 8/1969 | Wald et al. | 16/98 |
| 3,628,588 | 12/1971 | Dixon | 160/199 X |
| 4,099,599 | 7/1978 | Randall | 187/324 X |
| 4,149,615 | 4/1979 | Kappenhagen | 187/324 |
| 4,355,486 | 10/1982 | Sherwood | 49/409 |
| 4,642,844 | 2/1987 | Johnston | 16/98 |
| 5,083,639 | 1/1992 | Kappeler | 187/324 X |
| 5,165,142 | 11/1992 | Pilsbury | 16/90 |

FOREIGN PATENT DOCUMENTS

| | | | |
|---|---|---|---|
| 0478938 | 4/1992 | European Pat. Off. | B66B 13/30 |
| 2310286 | 12/1990 | Japan | 187/334 |
| 361964 | 12/1972 | U.S.S.R. | 187/324 |
| 535552 | 4/1941 | United Kingdom | B66B 13/30 |

*Primary Examiner*—James W. Keenan
*Assistant Examiner*—Scott L. Lowe
*Attorney, Agent, or Firm*—Greenblum & Bernstein, P.L.C.

[57] ABSTRACT

A roller guide for use with sliding elevator doors may include elements for effecting quieter sliding door running by reducing noise associated with the rollers running along the roller guide. The roller guide may by formed by a convex running surface made from a hose-like covering of sheet metal producing a spring effect. The hose-like covering may be dimensioned to utilize the spring effect within an elastic range or limit of the sheet metal, with the optimum spring effect occurring when a radius of the rail running surface is slightly less than a radius of a running surface. An elastic material, to dampen running noise, may be inserted between the hose-like covering and a carrier section. The carrier section may also include spaces for clamping respective ends of the hose-like covering.

19 Claims, 2 Drawing Sheets

ROLLER GUIDE FOR A SLIDING ELEVATOR DOOR

CROSS REFERENCE TO RELATED APPLICATIONS

This application claims the priority of European Application No. EP 94107450.2, filed May 13, 1994.

BACKGROUND OF THE INVENTION

1. Field of the Invention

The present invention pertains to a runner or roller guide for a sliding elevator door having a guide rail and rollers which roll along and over same and, for the purpose of quiet running and noise reduction, includes resilient and damping elements.

2. Discussion of the Background of the Invention and Material Information

A roller guide for a sliding elevator door, in which the rollers include non-metallic, hard-elastic running surface inserts, in order to assure quiet running and reduce running noises, is set forth in European Patent Publication EP-PS 478938 and in cognate U.S. Pat. No. 5,165,142. A roller-raising or lifting device relieves or unloads the running surfaces of the runners or rollers in the at rest positions in order to prevent flat spotting of the elastic running surface inserts and to avoid the consequent rumbling noises during door movements. This lifting device is constructed as a ramp member, including a ramp and a horizontal part, and is mounted laterally of the guide rail. The rim disks of the rollers enable a run-up onto the ramp member and a relief of the running surface.

In the previously described roller or runner guide, the running surfaces are relieved or unloaded by means of an expensive construction in order to prevent flat spotting. In the case of a worn running surface insert, the entire roller must be replaced. The use of hard materials for the guide rail moreover causes a further sound propagation in same. Beyond that, an embedding of foreign materials into the soft running surface insert of the rollers is also possible, and impairs the quiet running and increases the development of noise.

It is the task or object of this invention to construct a roller guide for a sliding elevator door of the previously described type, which does not include the noted disadvantages, is simple in mode and manner, and assures a high degree of quiet running.

SUMMARY OF THE INVENTION

This task or object is achieved in accordance with this invention in that the guide rail has an elastically yielding rail running surface, with the running surface being deformable within the elastic range of the material of its construction, when the rollers pass over the running surface.

In a further embodiment of the roller guide of this invention, the rail running surface includes an arcuate shape, with the arcuate shape preferably being convex or concave.

In another embodiment of the roller guide of this invention, the guide rail includes a carrier section having a rail running surface of sheet steel and a space between the carrier section and the rail running surface, wherein the space is one of wholly and partially filled by an elastic material filler. Preferably, the rail running surface is a component of a hose-shaped covering.

In a differing embodiment of the roller guide of this invention, the radius of the rail running surface is slightly smaller than the radius of a running surface of the rollers.

In yet a further embodiment of the roller guide of this invention, the hose-shaped covering is attached to the carrier section by screw fastening elements.

In yet another embodiment of the roller guide of this invention, the elasticity of the elastic material filler is adjustable via one of a screw element and a threaded movable plunger.

In yet a differing embodiment of the roller guide of this invention, the rail running surface is comprised of a steel tape spring, with the steel tape spring is embedded one side thereof in a filler comprised of rubber material.

In still a further embodiment of the roller guide of this invention, the rail running surface is a component of a profiled liner.

Still another embodiment of the roller guide of this invention further includes an elastic filler interposed between at least a portion of the carrier section and the profiled liner.

In still a differing embodiment of the roller guide of this invention, the carrier section further includes a downwardly-extending slot-shaped opening. Preferably, the elastic filler further includes sealing lips, with the sealing lips extending into the slot-shaped opening.

The advantages achieved by this invention reside substantially in that the developed noise, emanating from the door, even in continuous operation, is effectively reduced and the door is free from maintenance. The resilient part of the runner guide is, even during constant loading, stressed only within the elastic range or limit of the material of its construction. The production of the runners is greatly simplified and more cost effective. The guide rails are produced as bands or tapes in a cost effective manner. Through the use of elastic inserts in the guide rail, the propagation of sound is suppressed.

Since the running surfaces of the guide rail and the runners or rollers consist of hard material, an embedding of foreign materials is no longer possible, which in turn increases quiet running and thereby also achieves a further reduction of noise. Wear is counteracted by the large surface of the elastic part of the roller guide, and assures long service life of the guide rail.

BRIEF DESCRIPTION OF THE DRAWINGS

The invention, which will be described relative to several examples and embodiments thereof, will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
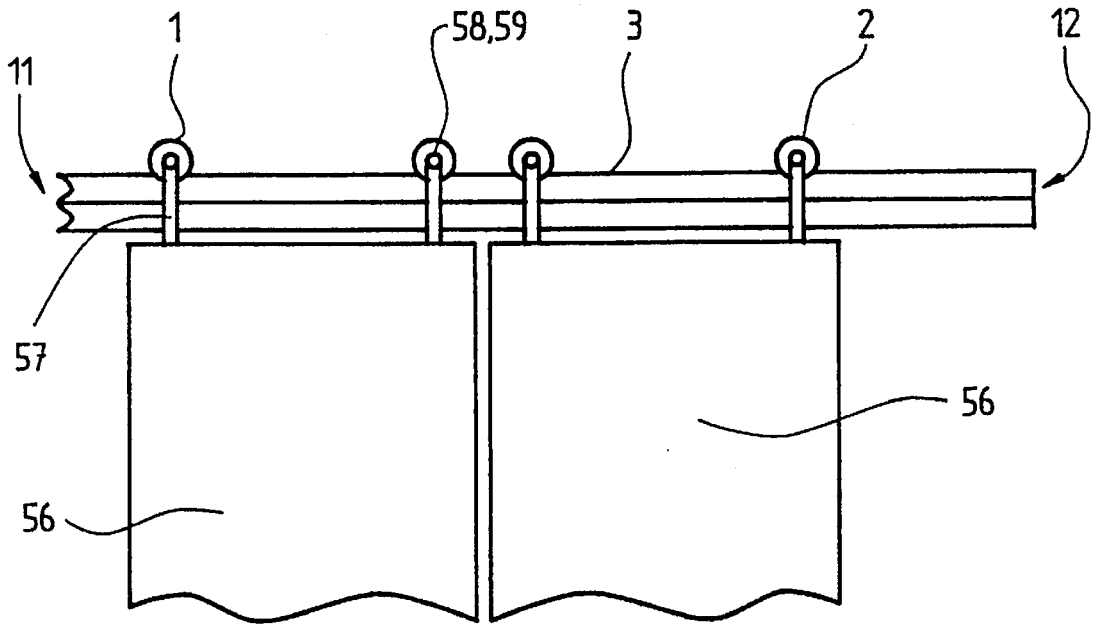
FIG. 1 is a schematic elevational showing of a sliding elevator door.

FIG. 1 is a schematic elevational view of a sliding lift or elevator door. Runners or rollers 1 travel, via their running surfaces along and over a rail running surface 3 of a guide rail 11. Rail running surface 3 preferably has an arcuate, in particular a concave or convex, shape in order to assure optimum guidance of runners 1 and is an integral component of guide rail 11. A door pane 56 with suspensions or hangers 57 is connected, via axles 58 and rolling element bearings 59 mounted thereon, with rollers 1. The elasticity of an elastic filling 5, to be described hereinafter, can be set or adjusted, according to the weight of the door and the desired closing speed, by a screw 12 at guide rail 11.

Figure 2A:
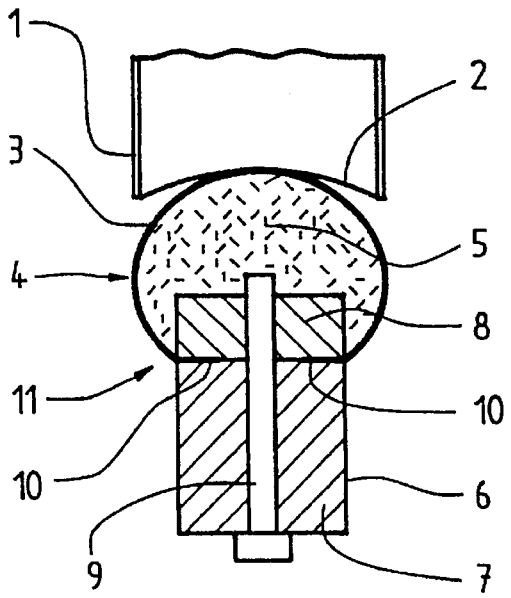
FIGS. 2*a* and 2*b*, which are cross sectional views, partly broken away, depict examples of first embodiments of a roller on a resilient and damped roller guide.

In FIG. 2*a*, which is an example of a first embodiment of this invention, numeral 1 denotes a runner or roller, preferably comprised entirely of a ceramic material or of metal, and the running or outer surface 2 of which rolls along and over rail running or outer surface 3. A hose-like or tube-like covering 4 of steel sheet, the rail running surface of which is convexly curved, is so dimensioned that the spring effect thereof is stressed or loaded only within the elastic limit or range of the sheet metal. In order to achieve an optimum spring effect, the radius of running or contact surface 2 of runner 1 is slightly greater than the radius of rail running surface 3. An elastic filling 5, for example of a rubber material, which dampens the running noise caused by the movement of runner 1 and prevents a propagation of sound in guide rail 11, is mounted or contained within hose-like covering 4. Hose-like covering 4 is retained by carrier section 6, which consists of a lower part 7 and an upper part 8, as well as a screw fastener 9. A cut-out or relief area 10, between lower part 7 and upper part 8, in carrier profile 6, affords space for the longitudinal edge portions of hose-like covering 4, wherein the clamping effect is achieved by several screw fasteners 9 distributed over the entire axial length of guide rail 11. Another possibility comprises welding or adhesively attaching hose-like covering 4 directly onto carrier section 6.

Figure 2B:
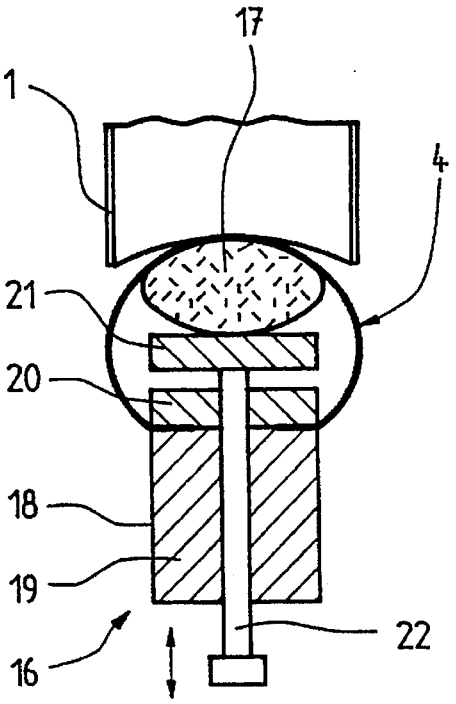

FIG. 2*b* shows another variation of this embodiment if increased demands or loads are required in comparison with the FIG. 2*a* embodiment. In place of elastic filling 5, an elastic cushion 17, for example of a rubber material, is inserted, within hose-like covering 4, over the entire length of a guide rail 16. Hose-like covering is fixed or retained, as in FIG. 2*a*, by a carrier section 18, which consists of a lower part 19, an upper part 20, and a movable plunger 21 having a threaded portion 22. Here, a possibility likewise exists of welding the hose-like covering 4 onto carrier section 18. Due to movable plunger 21 and its threaded portion 22, the pressure on elastic cushion 17 can be varied, which corresponds to a reduction or an increase in the spring travel. Due to the distribution or spacing of threaded portions 22 over the length of guide rail 16, different spring travel distances can be set according to the desired door speed and door weight.

Figure 2C:
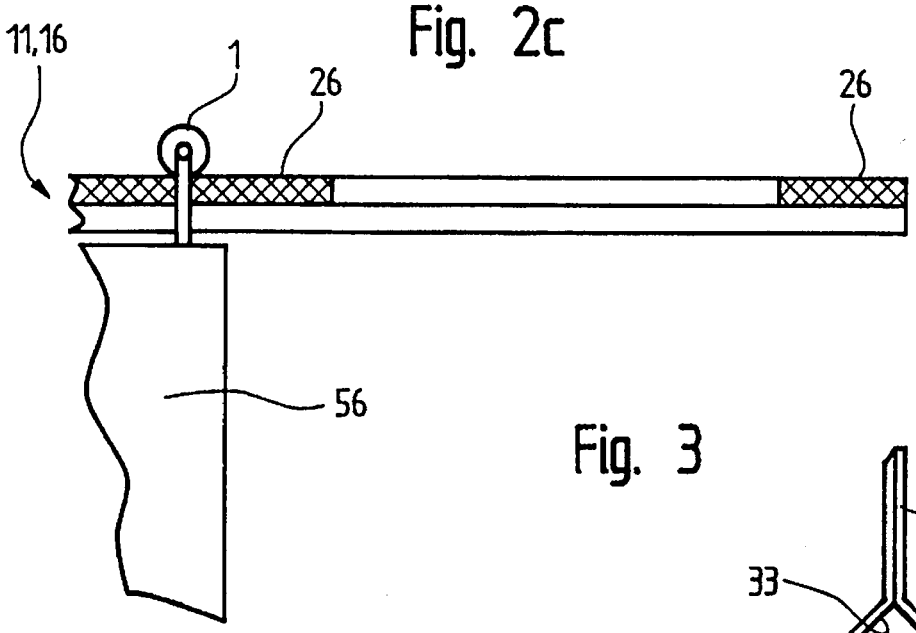
FIG. 2*c* is a view, similar to that of FIG. 1, showing the use of unsprung guide rail end zones.

FIG. 2*c* shows another embodiment of guide rails 11 and 16 that are utilized in the FIG. 2*a* and 2*b* constructions. Due to the mounting or positioning of hard, unsprung zones 26 at the standstill or at rest positions of runners 1, smaller starting moments are achieved, resulting in smaller canting or misalignment of door panes 56. These hard unsprung at-rest zones 26 can be produced by mounting different fillings 5 as per FIG. 2*a* or by varying the filling pressure via plunger 21 as per FIG. 2*b*.

Figure 3:
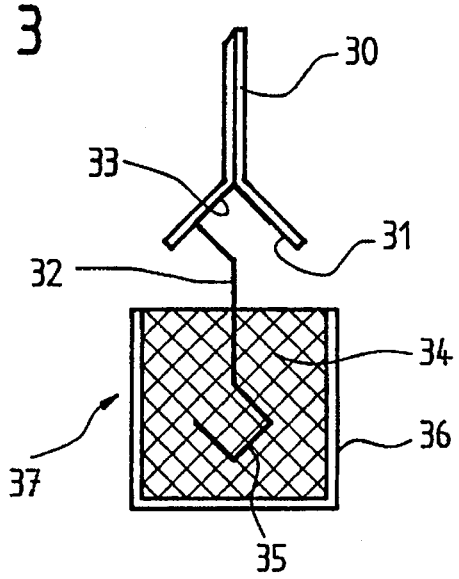
FIG. 3 is a sectional view of an example of a second embodiment with a roller on a steel tape spring embedded in damping material.

A second embodiment of this invention is shown in FIG. 3. A runner or roller 30, having a concave running surface 31, in this case, travels on a steel tape spring 32, having an inverse V-shaped rail running or travel surface 33, of springy metal. The outer shape of rail running surface 33 can be arcuate or curved in any desired manner, particularly convex. It can have a spring effect, particularly by reason of its shape, in comparison with the examples of the first embodiment of this invention. Steel tape spring 32 is embedded in a longitudinal side or an end of a damping and resilient rubber mass material 34. The terminal end 35 of steel spring 32, which is embedded in rubber mass material 34, can have any desired shape or configuration as long as it assures a good connection between rubber mass material 34 and steel tape spring 32. A carrier section 36 of sheet steel serves for the reception of rubber mass material 34 and as the load-carrying element of guide rail 37.

Figure 4:
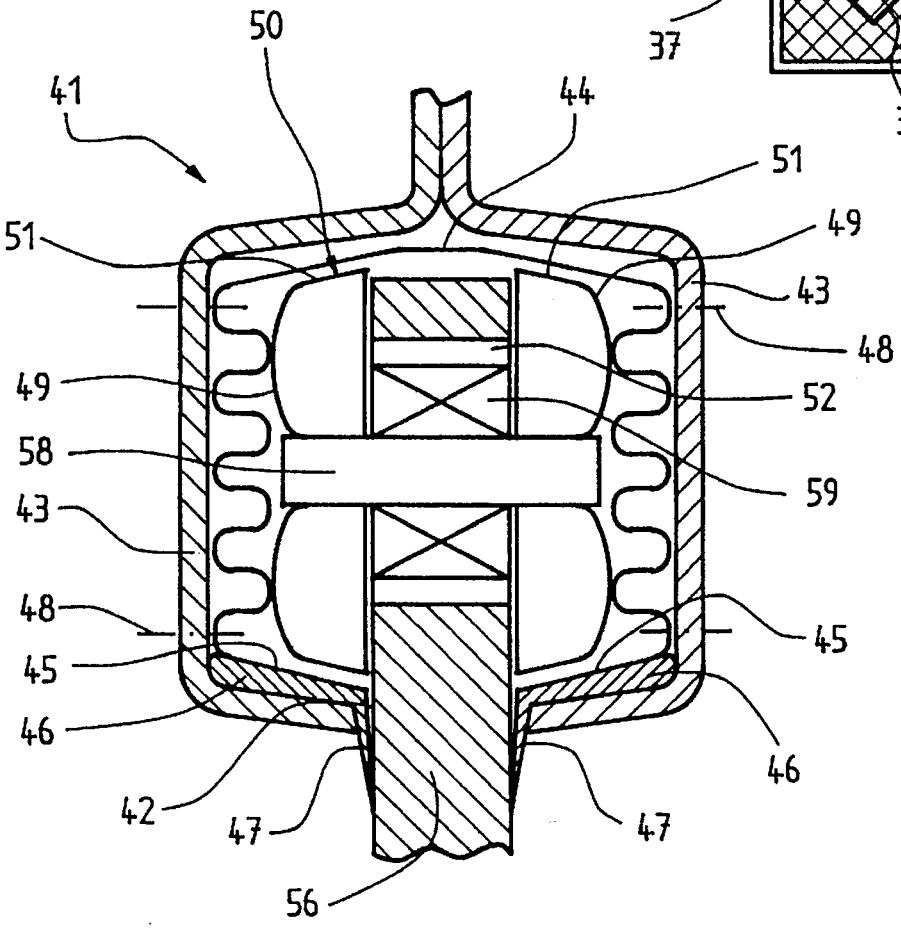
FIG. 4 is a sectional view of an example of a third embodiment with a roller on a guide rail provided with a damping internal section.

FIG. 4 shows a further embodiment of this invention wherein a guide rail 41 includes a cavity having a downwardly-extending slot-shaped opening 42. Guide rail 41 is comprised of two mirror image bowl-shaped carrier sections 42. A profiled lining or liner 44 in the interior cavity of guide rail 41 forms a rail running surface 45 in the region of slot-shaped opening 42. Carrier sections 43 and profiled lining 44 are so bent over or shaped, at their ends that form opening 42, that a groove-shaped rail running surface 45 is formed. Profiled lining 44 and a filler 46 are mounted within carrier sections 43 before the assembly of the latter. Elastic damping filling 46, which according to FIG. 4 can be restricted to the lower part of the cavity, is disposed or interposed between carrier sections 43 and profiled lining 44. Filling 46 is so shaped that it also forms sealing lips 47 adjoining door pane 56, in the region of opening 42, in order to protect rail running surface 45 against contamination. Profiled lining 44 is attached to carrier section 43 by means of fastening elements 48 (only shown schematically), for example by screws, but can however also be adhesively attached onto carrier sections 43. A runner or roller 50, comprised of two half shells 49, having centrally elevated or raised surfaces 51, rolls over rail running surface 45. Both half shells 49 are mounted on an axle 58 journalled via a rolling element bearing 59. A further damping insert 52 is disposed between rolling element bearings 59 an door pane 56 in order to prevent the propagation of sound in door pane 56.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A roller guide for a sliding elevator door comprising a guide rail for guiding a plurality of rollers, said roller guide comprising:

resilient damping elements;

an elastically yielding rail running surface;

a carrier section;

the elastically yielding running surface being fixed to the carrier section;

the resilient damping elements positioned within a space formed between the running surface and the carrier section; and the running surface being deformable within an elastic range of a material of its construction, when the rollers pass over the running surface.

2. The roller guide of claim 1, the material of the running surface comprising sheet steel and the space is one of wholly and partially filled by the resilient damping elements.

3. The roller guide of claim 1, wherein a radius of the running surface is slightly smaller than a radius of a running surface of one of the plurality of rollers.

4. The roller guide of claim 1, wherein the running surface is fixed to the carrier section by screw fastening elements.

5. The roller guide of claim 1, wherein the running surface includes an arcuate shape.

6. The roller guide of claim 5, wherein the arcuate shape is one of convex and concave.

7. The roller guide of claim 1, the resilient damping elements comprising an elastic material filling the space.

8. The roller guide of claim 7, the elastic material comprising rubber.

9. A roller guide for a sliding elevator door comprising:

a rail running surface for longitudinal traversal of at least one roller, the rail running surface including an arcuate shape;

a carrier section including retaining means for retaining said running surface;

a space formed between the carrier section and the running surface; and the running surface comprising sheet steel and the space is one of wholly and partially, filled by an elastic material filler.

10. The roller guide of claim 9, wherein the sheet steel is comprised of a steel tape spring.

11. A roller guide for a sliding elevator door comprising:

a rail running surface for longitudinal traversal of at least one roller, the rail running surface comprising a steel tape spring;

a carrier section including retaining means for retaining said running surface;

a space formed between the carrier section and the running surface; and a portion of the steel tape spring is embedded in a filler comprised of rubber material.

12. A roller guide for a sliding elevator door comprising:

a rail running surface for longitudinal traversal of at least one roller;

a carrier section including retaining means for retaining said running surface;

a space formed between the carrier section and the running surface; and the running surface is a component of a profiled liner.

13. The roller guide of claim 12, further including an elastic filler interposed between at least a portion of the carrier section and the profiled liner.

14. The roller guide of claim 13, wherein the carrier section further includes a downwardly-extending slot-shaped opening.

15. The roller guide of claim 14, wherein the elastic filler further includes sealing lips, with the sealing lips extending into the slot-shaped opening.

16. A roller guide for a sliding elevator door comprising:

a rail running surface for longitudinal traversal of at least one roller;

a carrier section including retaining means for retaining said running surface;

a space formed between the carrier section and the running surface; and an elastic material partially filling the space and positioned between the carrier section and the running surface.

17. The roller guide of claim 16, wherein the running surface is a component of a hose-shaped covering.

18. The roller guide of claim 16, wherein an elasticity of the elastic material is adjustable via one of a screw element and a threaded movable plunger.

19. The roller guide of claim 16, the elastic material comprising rubber.

* * * * *